US006770376B2

(12) United States Patent
Chen

(10) Patent No.: US 6,770,376 B2
(45) Date of Patent: Aug. 3, 2004

(54) COATED ARTICLE WITH POLYMERIC BASECOAT

(75) Inventor: Guocun Chen, Broomfield, CO (US)

(73) Assignee: Vapor Technologies, Inc., Boulder, CO (US)

( * ) Notice: Subject to any disclaimer, the term of this patent is extended or adjusted under 35 U.S.C. 154(b) by 0 days.

(21) Appl. No.: 09/746,476

(22) Filed: Dec. 21, 2000

(65) Prior Publication Data

US 2002/0081451 A1 Jun. 27, 2002

(51) Int. Cl.[7] ..... B32B 15/04

(52) U.S. Cl. ..... 428/457; 428/626; 428/625; 428/660; 428/425.8; 106/286.4

(58) Field of Search ..... 428/457, 626, 428/625, 660, 425.8; 106/286.4

(56) References Cited

U.S. PATENT DOCUMENTS 4,509,161 A * 4/1985 Van de Leest et al. ..... 369/275
5,336,565 A * 8/1994 Muromachi et al. ..... 428/432

* cited by examiner

*Primary Examiner*—James J. Seidleck
*Assistant Examiner*—Melanie Bissett
(74) *Attorney, Agent, or Firm*—Carlson, Gaskey & Olds

(57) ABSTRACT

An article is coated with a multi-layer coating having the appearance of nickel. The coating comprises a polymeric layer on the surface of said article and vapor deposited on the polymeric layer a refractory metal nitride or refractory metal alloy nitride where the nitrogen content of said nitride is from about 6 to about 45 atomic percent.

13 Claims, 3 Drawing Sheets

COATED ARTICLE WITH POLYMERIC BASECOAT

FIELD OF THE INVENTION

This invention relates to articles, particularly brass articles, having a multi-layered decorative and protective coating having the appearance or color of nickel thereon.

BACKGROUND OF THE INVENTION

It is currently the practice with various brass articles such as faucets, faucet escutcheons, door knobs, door handles, door escutcheons and the like to first buff and polish the surface of the article to a high gloss and to then apply a protective organic coating, such as one comprised of acrylics, urethanes, epoxies and the like, onto this polished surface. This system has the drawback that the buffing and polishing operation, particularly if the article is of a complex shape, is labor intensive. Also, the known organic coatings are not always as durable as desired, and are susceptible to attack by acids. It would, therefore, be quite advantageous if brass articles, or indeed other articles, either plastic, ceramic, or metallic, could be provided with a coating which provided the article with a decorative appearance as well as providing wear resistance, abrasion resistance and corrosion resistance. It is known in the art that a multi-layered coating can be applied to an article which provides a decorative appearance as well as providing wear resistance, abrasion resistance and corrosion resistance. This multi-layer coating includes a decorative and protective color layer of a refractory metal nitride such as a zirconium nitride or a titanium nitride. This color layer, when it is zirconium nitride, provides a brass color, and when it is titanium nitride provides a gold color.

U.S. Pat. Nos. 5,922,478; 6,033,790 and 5,654,108, inter alia, describe a coating which provides an article with a decorative color, such as polished brass, provides wear resistance, abrasion resistance and corrosion resistance. It would be very advantageous if a coating could be provided which provided substantially the same properties as the coatings containing zirconium nitride or titanium nitride but instead of being brass colored or gold colored was nickel colored. The present invention provides such a coating.

SUMMARY OF THE INVENTION

The present invention is directed to an article such as a plastic, ceramic or metallic article having a decorative and protective multi-layer coating deposited on at least a portion of its surface. More particularly, it is directed to an article or substrate, particularly a metallic article such as stainless steel, aluminum, brass or zinc, having deposited on its surface multiple superposed layers of certain specific types of materials. The coating is decorative and also provides corrosion resistance, wear resistance and abrasion resistance. The coating provides the appearance of nickel, i.e. has a nickel color tone. Thus, an article surface having the coating thereon simulates a nickel surface.

The article first has deposited on its surface a polymeric basecoat layer. On top of the polymeric layer is then deposited, by vapor deposition such as physical vapor deposition, one or more vapor deposited layers. More particularly disposed over the polymeric basecoat layer is a protective color layer comprised of a refractory metal nitride or a refractory metal alloy nitride wherein the refractory metal nitride or refractory metal alloy nitride is lightly nitrided, that is to say contains a small amount, i.e. less than stoichiometric amount, of nitrogen. Generally this amount of nitrogen is between about 6 to about 45 atomic percent.

DESCRIPTION OF THE PREFERRED EMBODIMENT

The article or substrate 12 can be comprised of any material onto which a plated layer can be applied, such as plastic, e.g., ABS, polyolefin, polyvinylchloride, and phenolformaldehyde, ceramic, metal or metal alloy. In one embodiment it is comprised of a metal or metallic alloy such as copper, steel, brass zinc, aluminum, nickel alloys and the like.

Figure 1:
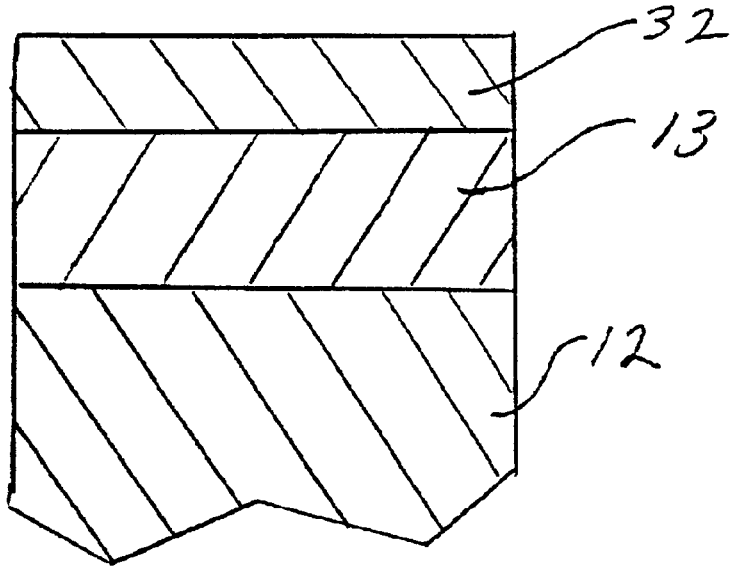
FIG. 1 is a cross sectional view of a portion of the substrate having a multi-layer coating comprising a polymeric base coat and a refractory metal nitride color and protective layer directly on the top polymeric layer.
Figure 2:
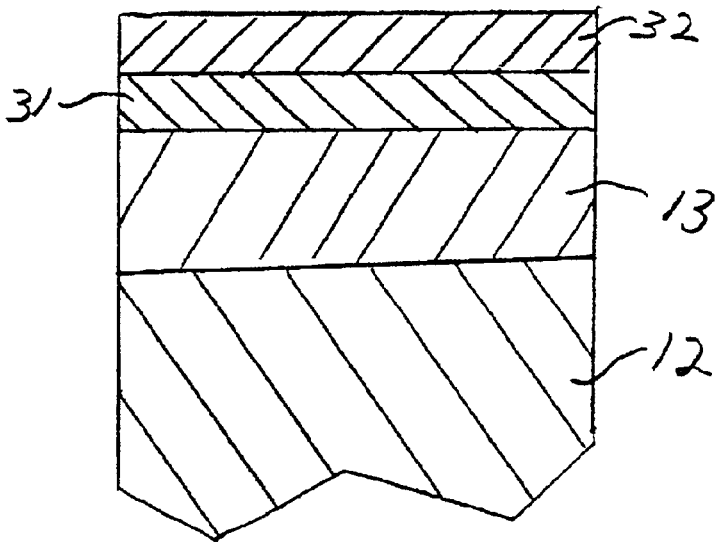
FIG. 2 is a view similar to FIG. 1 except that a refractory metal strike layer is present intermediate the polymeric layer and the refractory metal nitride layer.
Figure 3:
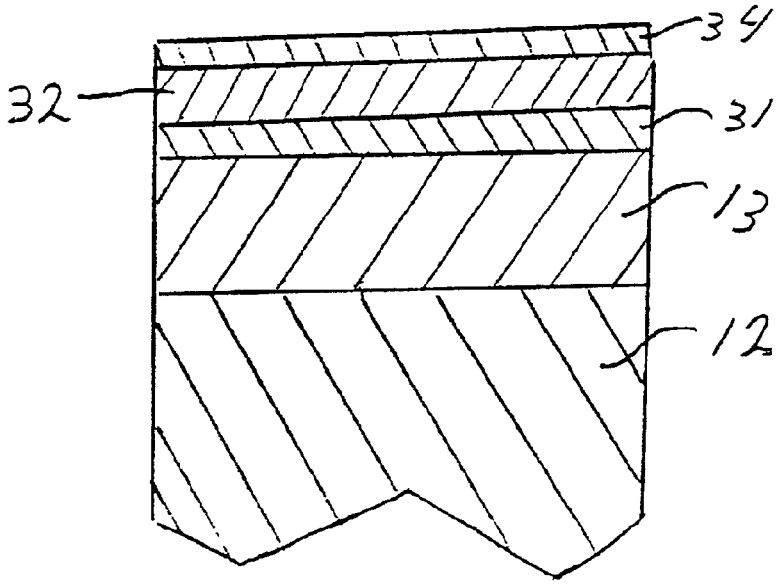
FIG. 3 is a view similar to FIG. 2 except that a refractory metal oxide layer is present on the refractory metal nitride color layer.

In the instant invention, as illustrated in FIGS. 1–3, a first polymeric or resinous layer is applied onto the surface of the article. A second layer(s) is applied onto the surface of the polymeric layer by vapor deposition. The polymeric layer serves, inter alia, as a basecoat which levels the surface of the article. The polymeric or base-coat layer 13 may be comprised of both thermoplastic and thermoset polymeric or resinous material. These polymeric or resinous materials include the well known, conventional and commercially available polycarbonates, epoxy urethanes, polyacrylates, polymethacrylates, nylons, polyesters, polypropylenes, polyepoxies, alkyds and styrene containing polymers such as polystyrene, styrene-acrylonitrile (SAN), styrene-butadiene, acrylonitrile-butadiene-styrene (ABS), and blends and copolymers thereof.

The polycarbonates are described in U.S. Pat. Nos. 4,579,910 and 4,513,037, both of which are incorporated herein by reference.

Nylons are polyamides which can be prepared by the reaction of diamines with dicarboxylic acids. The diamines and dicarboxylic acids which are generally utilized in preparing nylons generally contain from two to about 12 carbon atoms. Nylons can also be prepared by additional polymerization. They are described in "Polyamide Resins", D. E. Floyd, Reinhold Publishing Corp., New York, 1958, which is incorporated herein by reference.

The polyepoxies are disclosed in "Epoxy Resins", by H. Lee and K. Neville, McGraw-Hill, New York, 1957, and in U.S. Pat. Nos. 2,633,458; 4,988,572; 4,680,076; 4,933,429 and 4,999,388, all of which are incorporated herein by reference.

The polyesters are polycondensation products of an aromatic dicarboxylic acid and dihydric alcohol. The aromic dicarboxylic acids include terephthalic acid, isophthalic acid, 4,4'-diphenyl-dicarboxylic acid, 2,6-naphthalenedicarboxylic acid, and the like. Dihydric alcohols include the lower alkane diols with from two to about 10 carbon atoms such as, for example, ethylene glycol, propylene glycol, cyclohexanedimethanol, and the like. Some illustrative non-limiting examples of polyesters include polyethylene terephthalate, polybutylene terephthalate, polyethylene isophthalate, and poly(1,4-cyclohexanedimethylene terephthalate). They are disclosed in U.S. Pat. Nos. 2,465,319; 2,901,466 and 3,047,539, all of which are incorporated herein by reference.

The polyacrylates and polymethacrylates are polymers or resins resulting from the polymerization of one or more acrylates such as, for example, methyl acrylate, ethyl acrylate, butyl acrylate, 2-ethylhexyl acrylate, etc., as well as the methacrylates such as, for instance, methyl methacrylate, ethyl methacrylate, butyl methacrylate, hexyl methacrylate, etc. Copolymers of the above acrylate and methacrylate monomers are also included within the term "polyacrylates or polymethacrylates" as it appears therein. The polymerization of the monomeric acrylates and methacrylates to provide the polyacrylate resins useful in the practice of the invention may be accomplished by any of the well known polymerization techniques.

The styrene-acrylonitrile and acrylonitrile-butadiene-styrene resins and their preparation are disclosed, inter alia, in U.S. Pat. Nos. 2,769,804; 2,989,517; 2,739,142; 3,991,136 and 4,387,179, all of which are incorporated herein by reference.

The alkyd resins are disclosed in "Alkyd Resin Technology", Patton, Interscience Publishers, NY, N.Y., 1962, and in U.S. Pat. Nos. 3,102,866; 3,228,787 and 4,511,692, all of which are incorporated herein by reference.

The epoxy urethanes and their preparation are disclosed, inter alia, in U.S. Pat. Nos. 3,963,663; 4,705,841; 4,035,274; 4,052,280; 4,066,523; 4,159,233; 4,163,809; 4,229,335 and 3,970,535, all of which are incorporated by reference. Particularly useful epoxy urethanes are those that are electrocoated onto the article. Such electrodepositable epoxy urethanes are described in the aforementioned U.S. Pat. Nos. 3,963,663; 4,066,523; 4,159,233; 4,035,274 and 4,070,258.

These polymeric materials may optionally contain the conventional and well known fillers such as mica, talc and glass fibers.

The polymeric layer or basecoat layer 13 may be applied onto the surface of the substrate by any of the well known and conventional methods such as dipping, spraying, brushing and electrodeposition.

The polymeric layer 13 functions, inter alia, to level the surface of the substrate, cover any scratches or imperfections in the surface of the article and provide a smooth and even surface for the deposition of the succeeding layers such as the vapor deposited layers.

The polymeric basecoat layer 13 has a thickness at least effective to level out the surface of the article or substrate. Generally, this thickness is at least about 0.12 um, preferably at least about 2.5 um, and more preferably at least about 5 ums. The upper thickness range should not exceed about 250 um.

In some instances, depending on the substrate material and the type of polymeric basecoat, the polymeric basecoat does not adhere sufficiently to the substrate. In such a situation a primer layer is deposited on the substrate to improve the adhesion of the polymeric basecoat to the substrate. The primer layer can be comprised, inter alia, of halogenated polyolefins. The halogenated polyolefins are conventional and well known polymers that are generally commercially available. The preferred halogenated polyolefins are the chlorinated and brominated polyolefins, with the chlorinated polyolefins being more preferred. The halogenated, particularly chlorinated, polyolefins along with methods for their preparation are disclosed, inter alia, in U.S. Pat. Nos. 5,319,032; 5,840,783; 5,385,979; 5,198,485; 5,863,646; 5,489,650 and 4,273,894, all of which are incorporated herein by reference.

The thickness of the primer layer is a thickness effective to improve the adhesion of the polymeric basecoat layer to the substrate. Generally this thickness is at least about 0.01 mil. The upper thickness is not critical and generally is controlled by secondary considerations such as cost and appearance. Generally an upper thickness of about 2 mil should not be exceeded.

Over the polymeric basecoat layer is then deposited, by vapor deposition such as physical vapor deposition and chemical vapor deposition, at least a protective and color layer 32 comprised of a refractory metal nitride or a refractory metal alloy nitride wherein the nitride or nitrogen content is less than stoichiometric, generally from about 6 to about 45 atomic percent, preferably from about 8 to about 35 atomic percent. This amount of nitride provides the refractory metal nitride such as zirconium nitride, titanium nitride, hafnium nitride and tantalum nitride, preferably zirconium nitride, titanium nitride and hafnium nitride, or refractory metal alloy nitride such as zirconium-titanium alloy nitride, with a nickel color.

The thickness of this color and protective layer 32 is a thickness which is at least effective to provide the color of nickel and to provide abrasion resistance, scratch resistance, and wear resistance. Generally, this thickness is at least about 25 Å, preferably at least about 250 Å, and more preferably at least about 500 Å. The upper thickness range is generally not critical and is dependent upon secondary considerations such as cost. Generally a thickness of about 0.75 um, preferably about 0.5 um should not be exceeded.

One method of depositing layer 32 is by physical vapor deposition utilizing reactive sputtering or reactive cathodic arc evaporation. Reactive cathodic arc evaporation and reactive sputtering are generally similar to ordinary sputtering and cathodic arc evaporation except that a reactive gas is introduced into the chamber which reacts with the dislodged target material. Thus, in the case where zirconium nitride is the layer 32, the cathode is comprised of zirconium and nitrogen is the reactive gas introduced into the chamber.

In the embodiment illustrated in FIG. 1 the color and protective layer 32 is disposed directly on the polymeric basecoat layer 13. However, in other embodiments in addition to the protective color layer 32 there may optionally be present additional vapor deposited layers. These additional vapor deposited layers may include a layer comprised of refractory metal or refractory metal alloy. The refractory metals include hafnium, tantalum, zirconium and titanium. The refractory metal alloys include zirconium-titanium alloy, zirconium-hafnium alloy and titanium-hafnium alloy. The refractory metal layer or refractory metal alloy layer 31, if disposed intermediate the polymeric basecoat layer 13 and the color layer 32 as illustrated in FIG. 2, generally functions, inter alia, as a strike layer which improves the adhesion of the color layer 32 to the polymeric basecoat layer. As illustrated in FIGS. 2 and 3, the refractory metal or refractory metal alloy strike layer 31 is generally disposed intermediate the color layer 32 and the polymeric layer 13. Layer 31 has a thickness which is generally at least effective for layer 31 to function as a strike layer. Generally, this thickness is at least about 60 Å, preferably at least about 120 Å, and more preferably at least about 250 Å. The upper thickness range is not critical and is generally dependent upon considerations such as cost. Generally, however, layer 31 should not be thicker than about 1.2 um, preferably about 0.40 um, and more preferably about 0.25 um.

The refractory metal or refractory metal alloy layer 31 is deposited by conventional and well known vapor deposition techniques including physical vapor deposition techniques such as cathodic arc evaporation (CAE) or sputtering. Sputtering techniques and equipment are disclosed, inter alia, in J. Vossen and W. Kern "Thin Film Processes II", Academic Press, 1991; R. Boxman et al, "Handbook of Vacuum Arc Science and Technology", Noyes Pub., 1995; and U.S. Pat. Nos. 4,162,954 and 4,591,418, all of which are incorporated herein by reference.

Briefly, in the sputtering deposition process a refractory metal (such as titanium or zirconium) target, which is the cathode, and the substrate are placed in a vacuum chamber. The air in the chamber is evacuated to produce vacuum conditions in the chamber. An inert gas, such as Argon, is introduced into the chamber. The gas particles are ionized and are accelerated to the target to dislodge titanium or zirconium atoms. The dislodged target material is then typically deposited as a coating film on the substrate.

In cathodic arc evaporation, an electric arc of typically several hundred amperes is struck on the surface of a metal cathode such as zirconium or titanium. The arc vaporizes the cathode material, which then condenses on the substrates forming a coating.

In a preferred embodiment of the present invention the refractory metal is comprised of titanium or zirconium, preferably zirconium, and the refractory metal alloy is comprised of zirconium-titanium alloy.

The additional vapor deposited layers may also include refractory metal compounds and refractory metal alloy compounds other than the above described nitrides. These refractory metal compounds and refractory metal alloy compounds include the refractory metal oxides and refractory metal alloy oxides; the refractory metal carbides and refractory metal alloy carbides; reaction products of (a) refractory metal or refractory metal alloy, (b) oxygen, and (c) nitrogen; and the refractory metal carbonitrides and refractory metal alloy carbonitrides.

In one embodiment of the invention as illustrated in FIG. 3 a layer 34 comprised of the reaction products of (i) a refractory metal or metal alloy, (ii) an oxygen containing gas such as oxygen, and (iii) nitrogen is deposited onto layer 32. The metals that may be employed in the practice of this invention are those which are capable of forming both a metal oxide and a metal nitride under suitable conditions, for example, using a reactive gas comprised of oxygen and nitrogen. The metals may be, for example, tantalum, hafnium, zirconium, zirconium-titanium alloy, and titanium, preferably titanium, zirconium-titanium alloy and zirconium, and more preferably zirconium.

The reaction products of the metal or metal alloy, oxygen and nitrogen are generally comprised of the metal or metal alloy oxide, metal or metal alloy nitride and metal or metal alloy oxy-nitride.

Thus, for example, the reaction products of zirconium, oxygen and nitrogen comprise zirconium oxide, zirconium nitride and zirconium oxy-nitride. These metal oxides and metal nitrides including zirconium oxide and zirconium nitride alloys and their preparation and deposition are conventional and well known, and are disclosed, inter alia, in U.S. Pat. No. 5,367,285, the disclosure of which is incorporated herein by reference.

The layer 34 can be deposited by well known and conventional vapor deposition techniques, including reactive sputtering and cathodic arc evaporation.

In another embodiment instead of layer 34 being comprised of the reaction products of a refractory metal or refractory metal alloy, oxygen and nitrogen, it is comprised of refractory metal oxide or refractory metal alloy oxide. The refractory metal oxides and refractory metal alloy oxides of which layer 34 is comprised include, but are not limited to, hafnium oxide, tantalum oxide, zirconium oxide, titanium oxide, and zirconium-titanium alloy oxide, preferably titanium oxide, zirconium oxide, and zirconium-titanium alloy oxide, and more preferably zirconium oxide. These oxides and their preparation are conventional and well known.

Layer 34 is effective in providing improved chemical, such as acid or base, resistance to the coating. Layer 34 containing (i) the reaction products of refractory metal or refractory metal alloy, oxygen and nitrogen, or (ii) refractory metal oxide or refractory metal alloy oxide generally has a thickness at least effective to provide improved chemical resistance. Generally this thickness is at least about 10 Å, preferably at least about 25 Å, and more preferably at least about 40 Å. Layer 34 should be thin enough so that it does not obscure the color of underlying color layer 32. That is to say layer 34 should be thin enough so that it is non-opaque or substantially transparent. Generally layer 34 should not be thicker than about 500 Å, preferably about 150 Å, and more preferably about 70 Å.

In order that the invention may be more readily understood, the following example is provided. The example is illustrative and does not limit the invention thereto.

EXAMPLE

Brass faucets are placed in a conventional soak cleaner bath containing the standard and well known soaps, detergents, defloculants and the like which is maintained at a pH of 8.9–9.2 and a temperature of 180–200° F. for about 10 minutes. The brass faucets are then placed in a conventional ultrasonic alkaline cleaner bath. The ultrasonic cleaner bath has a pH of 8.9–9.2, is maintained at a temperature of about 160–180° F., and contains the conventional and well known soaps, detergents, defloculants and the like. After the ultrasonic cleaning the faucets are rinsed and dried.

A basecoat polymeric composition is applied onto the cleaned and dried faucets by a standard and conventional high volume low pressure gun. The polymer is comprised of 35 weight percent styrenated acrylic resin, 30 weight percent melamine formaldehyde resin, and 35 weight percent bisphenol A epoxy resin. The polymer is dissolved in sufficient solvents to provide a polymeric composition containing about 43 weight percent solids. After the basecoat is applied onto the faucets the faucets are allowed to sit for 20 minutes for ambient solvent flash off. The faucets are then baked at 375° F. for two hours. The resulting cured polymeric basecoat has a thickness of about 0.8 mil.

The polymeric coated faucets are placed in a cathodic arc evaporation plating vessel. The vessel is generally a cylindrical enclosure containing a vacuum chamber which is adapted to be evacuated by means of pumps. A source of argon gas is connected to the chamber by an adjustable valve for varying the rate of flow of argon into the chamber. In addition, a source of nitrogen gas is connected to the chamber by an adjustable valve for varying the rate of flow of nitrogen into the chamber.

A cylindrical cathode is mounted in the center of the chamber and connected to negative outputs of a variable D.C. power supply. The positive side of the power supply is connected to the chamber wall. The cathode material comprises zirconium.

The polymer coated faucets are mounted on spindles, 16 of which are mounted on a ring around the outside of the cathode. The entire ring rotates around the cathode while each spindle also rotates around its own axis, resulting in a so-called planetary motion which provides uniform exposure to the cathode for the multiple faucets mounted around each spindle. The ring typically rotates at several rpm, while each spindle makes several revolutions per ring revolution. The spindles are electrically isolated from the chamber and provided with rotatable contacts so that a bias voltage may be applied to the substrates during coating.

The vacuum chamber is evacuated to a pressure of about $10^{-5}$ to $10^{-7}$ torr and heated to about 100° C.

The polymer coated faucets are then subjected to a high-bias arc plasma cleaning in which a (negative) bias voltage of about 500 volts is applied to the polymer coated faucets while an arc of approximately 500 amperes is struck and sustained on the cathode. The duration of the cleaning is approximately five minutes.

Argon gas is introduced at a rate sufficient to maintain a pressure of about 1 to 5 millitorr. A layer of zirconium having an average thickness of about 0.1 um is deposited on the polymer coated faucets during a three minute period. The cathodic arc deposition process comprises applying D.C. power to the cathode to achieve a current flow of about 500 amps, introducing argon gas into the vessel to maintain the pressure in the vessel at about 1 to 5 millitorr and rotating the faucets in a planetary fashion described above.

After the zirconium layer is deposited a zirconium nitride protective and color layer is deposited on the zirconium layer. A flow of nitrogen is introduced into the vacuum chamber while the arc discharge continues at approximately 500 amperes. The flow of nitrogen is a flow which will produce a zirconium nitride layer having nitrogen content of about 14 to 35 percent. This flow is about 10 to 20% of total flow, and is continued for about 20 to 35 minutes to form a zirconium nitride layer having a thickness of about 1,500 to 7,500 Å. After this zirconium nitride layer is deposited the nitrogen flow is terminated and a flow of oxygen of approximately 30 to 70 standard liters per minute is introduced for a time of about 10 to 60 seconds. A thin layer of zirconium oxide with a thickness of about 10 to 100 Å is formed. The arc is extinguished, the vacuum chamber is vented and the coated articles removed.

While certain embodiments of the invention have been described for purposes of illustration, it is to be understood that there may be various embodiments and modifications within the general scope of the invention.

I claim:

1. An article having on at least a portion of a surface a multi-layer coating having the appearance of nickel comprising:

a layer comprised of polymer; and a layer comprised of refractory metal nitride or refractory metal alloy nitride where said nitrogen content of said refractory metal nitride or refractory metal alloy nitride is from about 6 to about 45 atomic percent, and said layer comprised of refractory metal nitride or refractory metal alloy nitride providing the appearance of a nickel color.

2. The article of claim 1 wherein said nitrogen content is from about 8 to about 35 atomic-percent.

3. The article of claim 1 wherein a layer comprised of refractory metal or refractory metal is on said layer comprised of polymer.

4. The article of claim 1 wherein a layer comprised of refractory metal oxide or refractory metal alloy oxide is on said layer comprised of refractory meal nitride or refractory metal alloy nitride.

5. The article of claim 3 wherein a layer comprised of refractory metal oxide or refractory metal alloy oxide is on said layer comprised of refractory meal nitride or refractory metal alloy nitride.

6. The article of claim 1 wherein a layer comprised of the reaction products of (i) refractory metal, (ii) oxygen and (iii) nitrogen is on said layer comprised of refractory meal nitride or refractory metal alloy nitride.

7. The article of claim 3 wherein a layer comprised of the reaction products of (i) refractory metal, (ii) oxygen and (iii) nitrogen is on said layer comprised of refractory meal nitride or refractory metal alloy nitride.

8. An article having on at least a portion of a surface a multi-layer coating having the appearance of nickel comprising:

a layer comprised of epoxy urethane; and a layer comprised of refractory metal nitride or refractory metal alloy nitride where said nitrogen content of said refractory metal nitride or refractory metal alloy nitride is from about 6 to about 45 atomic percent.

9. The article of claim 1 wherein a layer comprised of the reaction products of (i) refractory metal alloy, (ii) oxygen and (iii) nitrogen is on said layer comprised of refractory meal nitride or refractory metal alloy nitride.

10. The article of claim 3 wherein a layer comprised of the reaction products of (i) refractory metal alloy, (ii) oxygen and (iii) nitrogen is on said layer comprised of refractory meal nitride or refractory metal alloy nitride.

11. The article of claim 1 wherein said layer comprised of refractory metal nitride or refractory metal alloy nitride is one of zirconium nitride, titanium nitride, hafnium nitride, tantalum nitride, and zirconium-titanium alloy nitride.

12. The article of claim 6 wherein said refractory metal is one of tantalum, hafnium, zirconium and titanium.

13. The article of claim 9 wherein said refractory metal alloy is zirconium-titanium alloy.

* * * * *

UNITED STATES PATENT AND TRADEMARK OFFICE

CERTIFICATE OF CORRECTION

PATENT NO. : 6,770,376 B2
DATED : August 3, 2004
INVENTOR(S) : Chen

It is certified that error appears in the above-identified patent and that said Letters Patent is hereby corrected as shown below:

Column 8,
Line 9, please insert -- alloy -- after "metal" and before "is"
Lines 17, 21, 25, 38 and 42, "meal" should be -- metal --

Signed and Sealed this

Eighteenth Day of January, 2005

JON W. DUDAS
*Director of the United States Patent and Trademark Office*